US005543615A

United States Patent [19]

Saitō et al.

[11] Patent Number: 5,543,615

[45] Date of Patent: Aug. 6, 1996

[54] BEAM CHARGE EXCHANGING APPARATUS

[75] Inventors: Mutsumi Saitō; Tomoyuki Yahiro; Masahiro Hatakeyama, all of Kanagawa-ken, Japan

[73] Assignee: Ebara Corporation, Tokyo, Japan

[21] Appl. No.: 371,775

[22] Filed: Jan. 12, 1995

[30] Foreign Application Priority Data

Jan. 13, 1994 [JP] Japan ..... 6-014861
Apr. 14, 1994 [JP] Japan ..... 6-100579

[51] Int. Cl.[6] ..... G21K 1/14; H05H 3/02

[52] U.S. Cl. ..... 250/251

[58] Field of Search ..... 250/251; 376/130; 324/464, 71.3

[56] References Cited

U.S. PATENT DOCUMENTS

| | | | |
|---|---|---|---|
| 3,790,787 | 2/1974 | Geller | 250/251 |
| 4,092,534 | 5/1978 | Anderson | 250/251 |
| 4,284,952 | 8/1981 | Fink | 250/251 |
| 4,549,082 | 10/1985 | McMillan | 250/423 R |

FOREIGN PATENT DOCUMENTS

| | | |
|---|---|---|
| 1-220353 | 9/1989 | Japan . |
| 3-257181 | 11/1991 | Japan . |
| 5-129096 | 5/1993 | Japan . |
| 5-144408 | 6/1993 | Japan . |
| 2008310 | 5/1979 | United Kingdom . |

OTHER PUBLICATIONS

Yencha et al., International Journal of Mass Spectrometry and Ion Physics, 14 (1974) pp. 401–413.

Barinov et al., Teplofizika Vysokikh Temperatur, vol. 11, No. 3, May–Jun., 1973 pp. 602–608, translation pp. 537–542.

Noda, "Electron Stripping of He and H in Helium, Hydrogen and Nitrogen Gases from 0.2 keV to 5.0 keV", *Journal of the Physical Society of Japan*, vol. 41, No. 2, Aug. 1976, pp. 625–632.

Teshima, "Generation of a Thin Plate Jet by a Rectangular Orifice", *Department of Aeronautical Engineering*, Jan. 1987, pp. 179–181.

Nagai, "A FAB Source for SIMS—Studies of a Gas Discharge Type FAB Source",*NTT*, Oct. 1988, pp. 29–39.

Anderson, Jr., "Gasdynamic Lasers: An Introduction", *Department of Aerospace Engineering*, pp. 147–148.

Patent Abstracts of Japan, vol. 7, No. 162 (E–187) Jul. 15, 1958.

Vetrovec, "Gas Jet Neutralizer for MFTF–B Pure Beam Injectors", *Proceedings of the 11th Symposium on Fusion Engineering*, vol. 1, Austin, Texas, Nov. 18–22, 1985, pp. 176–179.

*Primary Examiner*—Jack I. Berman
*Attorney, Agent, or Firm*—Wenderoth, Lind & Ponack

[57] ABSTRACT

A beam charge exchanging apparatus causes the charges of charged particles in a fast particle beam to be exchanged with charges of a gas or other fluid. The apparatus includes; a gas/fluid container disposed in a vacuum and having holes which allow the fast particle beam to pass through the container, a source of gas or other fluid, and a nozzle for introducing the gas into the container. The source and the nozzle are designed to introduce a high speed gas/fluid into the container so that the fast particle beam will collide with the high speed gas/fluid in the container and the charges thereof will be exchanged such that the fast particle beam is converted into a neutral particle beam. The apparatus may further include elements for detecting the quantity of neutral particles resulting from the charge exchange by measuring the quantity of generated ionized gas as an electric current.

22 Claims, 3 Drawing Sheets

BEAM CHARGE EXCHANGING APPARATUS

BACKGROUND OF THE INVENTION

1. Field of the Invention

This invention relates to a beam charge exchanging apparatus for converting a fast charged particle beam such as an ion beam into a neutral particle beam, the apparatus being employed in the manufacture of semiconductors or the like.

2. Prior Art

Conventionally, an apparatus shown in FIG. 7, which is known as a gas cell, has been widely used as a charge exchanging apparatus. The gas cell includes a gas container 6, which is placed in a vacuum container and includes holes 16 through which a charged particle beam is passed. The charged particle beam 1 which is passed through the gas container 6 collides with a gas 3, which is introduced in the gas container through a gas introducing pipe (not shown), whereby charges are exchanged between the charged particle beam and the gas. There is another conventional apparatus called a metallic vapor cell which employs an alkaline metallic vapor such as Li as a gas for the cell. In this apparatus, the charged particle beam 1 is passed through the vapor so as to cause the charged particle to collide with the metallic vapor, whereby charges are exchanged therebetween.

In the conventional gas cell, however, since gas 3 is introduced into the gas container 6 located in the vacuum container, the holes 16 of the gas container 6 should be made small to prevent the vacuum from deteriorating due to the diffusion of gas from the gas cell. For this reason, it has been impossible to obtain many gas particles or charged particles in the gas cell.

The metallic vapor cell has a similar drawback in that the quantity of beams introduced in the container is limited if the vacuum level is to be maintained has another drawback in that the container body is damaged by the chemically active alkaline metal.

According to the charge neutralizing method based on a molecular beam as disclosed in Japanese Patent Laid-Open Appln. No. 5-129096 which has recently been published, the charge exchanging efficiency is low because the number of molecules is limited and, therefore, it is difficult to accomplish a charge exchange for a large quantity of beams. Furthermore, using the aforesaid method to change a large quantity of ion beams into neutral beams requires a large apparatus. Hence, it has been difficult to obtain high-energy neutral particle beams effectively, and the highest possible energy value which could be obtained using this method is limited to a few KeV.

Furthermore, in the conventional charge exchanging apparatus, there was no means for immediately measuring the quantity of neutral particles after charge exchange.

SUMMARY OF THE INVENTION

Therefore, this invention has been made to solve the above problems, and it is an object of the present invention to provide an apparatus which is capable of exchanging the charges of a large quantity of high-energy beams with another media with high efficiency.

It is an another object of the present invention to provide an apparatus which is capable of exchanging the charges of a large quantity of high-energy beams with another media with high efficiency and of measuring the quantity of obtained neutral particles.

In order to accomplish the first object, the present invention provides a beam charge exchanging apparatus including a gas fluid container disposed in a vacuum and having holes for passing allowing a particle beam to pass through the container; a source of gas; and means for introducing the gas/fluid into the container at a high speed so that the fast particle beam will collide with the high speed gas/fluid in the container and a charge exchange will occur therebetween that converts the particle beam into a neutral particle beam.

In order to accomplish the second object, the apparatus further includes means for detecting the quantity of neutral particles resulting from the exchange of charges by detecting the quantity of ionized fluid generated as an electric current.

According to the present invention as described above, a charged particle beam is passed through a high speed gas/fluid having directivity in the container so as to convert the charged particle beam into a neutral particle beam. Therefore, the problem in which the high speed gas/fluid diffuses out of the container through the holes can be prevented. Hence, it is possible to make the holes of the container larger to increase the area of contact between the gas/fluid and the charged particle beam within the container, whereby a highly efficient charge exchange can be achieved, leading to the production of higher energy beams.

As the charged particle beam is passed through the high speed gas/fluid, the high speed gas/fluid obtains surplus charges resulting from the charge exchange. Accordingly, the high speed gas/fluid is charged, i.e. is ionized. The ionized gas/fluid can be collected on an ion capturing electrode and the quantity of ions in the gas/fluid can be measured by measuring the current flowing through the electrode. Thus, the quantity of the neutral particles in the neutral beam can be measured.

The above and other objects, features and advantages of the present invention will become more apparent from the following description when taken in conjunction with the accompanying drawings in which preferred embodiments of the present invention are described by way of illustrative examples.

DETAILED DESCRIPTION OF PREFERRED EMBODIMENTS OF THE INVENTION

Figure 1:
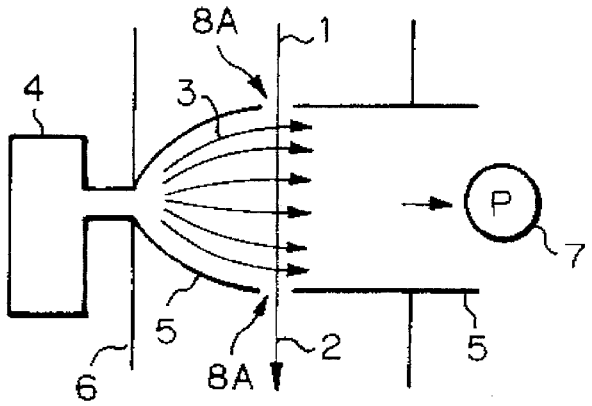
FIG. 1 is a diagram illustrating a first embodiment of a beam charge-exchanging apparatus according to the present invention wherein a divergent nozzle is provided with holes through which beams pass.
Figure 2:
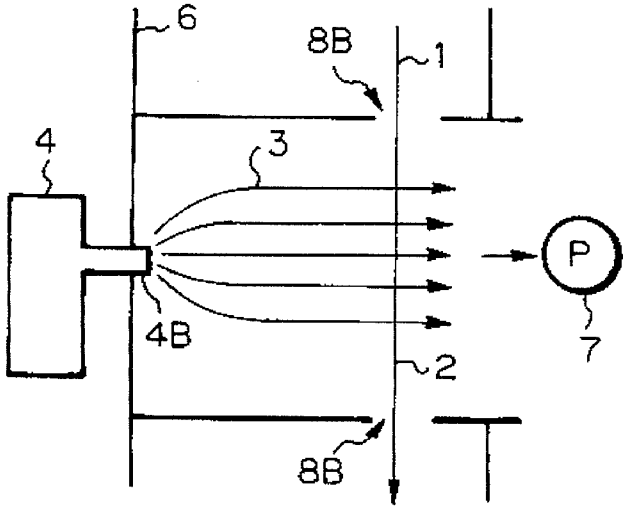
FIG. 2 is a diagram illustrating a second embodiment of a beam charge-exchanging apparatus of the invention wherein a gas is converted into a free jet through a nozzle of a reservoir tank.
Figure 3:
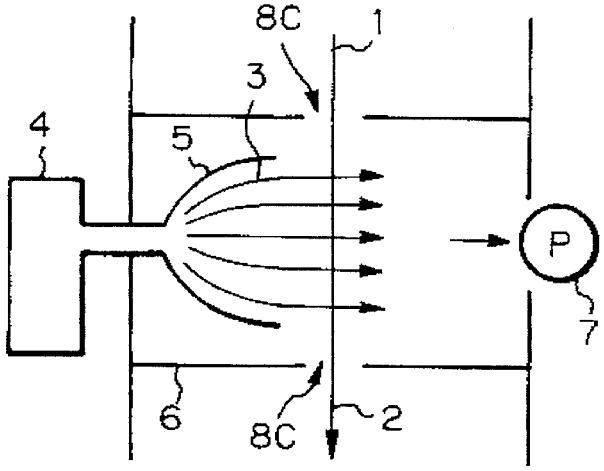
FIG. 3 is a diagram illustrating a third embodiment a beam charge-exchanging apparatus of the invention wherein a divergent nozzle is provided in the container.

FIGS. 1 to 3 respectively show examples of a beam charge exchanging apparatus to which the present invention is applied. Reference numeral i denotes an ion beam before charge exchange; reference numeral 2 denotes a neutral particle beam after charge exchange; reference numeral 3 denotes a high speed fluid such as a gas which comes in contact with the beam 1 to effect the charge exchange; and reference numeral 4 denotes a reservoir tank of the gas 3. Reference numeral 5 denotes a divergent nozzle which converts the gas 3 into a supersonic stream and causes the velocity vector of the gas 3 to be perpendicular to the beam 1; reference numeral 6 denotes a gas container of the beam charge exchanging apparatus; and reference numeral 7 denotes a vacuum pump which exhausts the gas 3 coming out of the nozzle 5 or container 6. By selecting a proper shape of the nozzle 5 and a proper gas pressure for the reservoir tank 4, the gas 3 emitted from the nozzle 5 can be made into a supersonic stream, the velocity vector of which is not directed toward the holes 8A. Therefore, the gas is less liable to exit through the holes 8A in the container 6 through which the beams 1 and 2 pass, thus making it possible to maintain a great pressure difference between the inside and the outside of the container 6.

FIG. 1 shows the divergent nozzle 5 which has, at the middle thereof, the holes 8A through which the beams 1 and 2 pass. This structure allows the charged particle (ion) beam to pass through gas issuing from the gas reservoir tank 4 and which gas has been expanded and accelerated via the gas nozzle 5 so as to convert the charged particle beam 1 into the neutral particle beam 2.

FIG. 2 shows the fluid formed as a free jet in the container 6 by the nozzle 4B of the gas reservoir tank 4. Holes 8B through which the beams 1 and 2 pass are provided in the top and bottom surfaces of the container 6. This structure allows the charged particle (ion) beam 1 to pass through the holes 8B of the container 6 and travel through the high speed gas, which flows as a free jet through a nozzle 4B of the gas reservoir tank, so as to convert the charged particle beam 1 into the neutral partical beam 2.

The apparatus shown in FIG. 3 has the divergent nozzle 5 provided in the container 6; charges are exchanged between the fluid, which has been expanded and accelerated, and the charged particle beam 1 which enters through a hole 8C of the container 6 to produce the neutral particle beam 2 which exits through another hole 8C.

Now, for example, in the embodiments shown in FIGS. 1 and 3, if it is assumed that the cross-sectional area of the converged section of the nozzle is denoted by S1 and the area of the diverged section of the nozzle is denoted by S2, the ratio of S2 to S1 is selected so that $$S2/S1 = 30$$

If the pressure of the reservoir tank 4 is 1300 Pa and the gas is Ar, then the Ar gas is released from the nozzle 5 as a supersonic jet of approximately Mach 7 which has a pressure of 0.74 Pa and which has linear directivity in the container 6. Thus, the Ar gas 3 collides with the ion beam 1 so that the charge exchange is performed therebetween, and it is then exhausted out of the container 6 by the vacuum pump 7. This structure provides the advantage of a high probability of successful collision between the ion beam and the Ar gas in the container 6 while maintaining the outside of the container 6 at a high degree of vacuum. Thus, a great number of neutral particle beams can be obtained.

The molecular velocity of the high speed fluid is preferably supersonic (5>M>1.2 where Mach value is denoted by M) or hypersonic (M>5 where Mach value is denoted by M). The flowing sonic velocity a of the gas is given by:

$$a=(KRT)^{1/2}$$

where K: Ratio of specific heat; R: Gas constant; and T: Temperature.

In the case of the Ar gas:

when K=1.658; R=208.15; and T=20 (K°); the following flowing velocities are approximately required:

Supersonic 100~415 m/s

Hypersonic >415 m/s

As described above, the supersonic nozzle and the harpersonic nozzle can be fabricated by selecting proper shapes for the nozzles, proper gas pressures, etc.

By preparing nozzles for a wide range of flow velocities, it is possible to select a gas fluid velocity which matches the energy (velocity) of a variety of charged particle beams to be subjected to charge exchange. This enhances the controllability of the probability of the charge exchange of high energy particles, thus enabling a higher exchange efficiency.

The state of the free molecular flow of a high speed gas fluid is defined by:

Mean free path of gas ($\lambda$)/Representative dimension of nozzle (L)>1

$\lambda$/L is known as the Knudsen value; for a desirable charge exchange, the high speed fluid should be in a state of free molecular flow having a Knudsen value of 1 or more.

Mean free path $\lambda=2.3\times10^{-20}$ T/Pa$^2$ (cm)

where T: Temperature (OK); P: Pressure (Torr); a: Diameter of molecule (cm). Therefore, the Ar gas is put in the state of free molecular flow if $$\lambda>34 \text{ (cm)}$$

when T=20 (° K.); p=1×10-5 (Torr); and a=$3.67\times10^{-8}$ (cm).

Unlike the gas introduction method in a conventional charge exchanging gas cell, the beam charge exchanging apparatus according to this invention makes it possible to use larger holes through which charged particles pass without comprising the vacuum outside the gas. This enables more neutral particle beams to be obtained with higher efficiency than in the conventional apparatus. This is achieved by selecting a nozzle of a proper size, so that the velocity of a fluid emitted through the nozzle has a very little component of its velocity vector oriented in a direction toward a hole through which beams pass.

Further, since the high speed fluid from the nozzle causes an adiabatic expansion of the gas, it is possible to obtain a high speed fluid with a higher density, i.e. a high speed fluid having more particles, than that in a gas cell container of the same pressure, thus increasing the probability of charge exchange. Such a high speed fluid allows a sufficiently large difference in pressure to be created between the inside and outside of the gas container, i.e. between the gas container and the vacuum container. In other words, a large volume of gas can be introduced in the gas container without impairing the vacuum outside the container. The gas in the gas container which has been used for charge exchange is exhausted by a vacuum pump or is circulated for reuse, thus preventing the gas from diffusing to the vacuum container of the beam system.

In the conventional charge exchanging apparatus, since the gas or metallic vapor in the gas container has random velocity vectors it diffuses through holes in the container through which a beam passes and therefore, adversely affects the pressure in the vacuum container. The apparatus of this embodiment is capable of achieving a highly efficient charge exchange, thereby enabling a large quantity of beams to be obtained. The apparatus is especially useful for neutralizing a beam of high energy charged particles, for instance a beam of about a few MeV, which used to be difficult in the past. Moreover, it is also possible to use a nozzle smaller than that used in the past, such that the charge exchanging apparatus is smaller accordingly.

The description given above refers to a high speed fluid such as Ar gas or the like; however, the high speed fluid may be a metallic vapor such as Na, Ka, and Cs or a liquid such as a liquid nitrogen. Using a variety of types of high speed fluids makes it possible to carry out the charge exchange process with respect to charged particle beams of a variety of elements and energy values. Thus, various modifications can be imparted to the embodiments described above without departing from the gist of the present invention.

Figure 4:
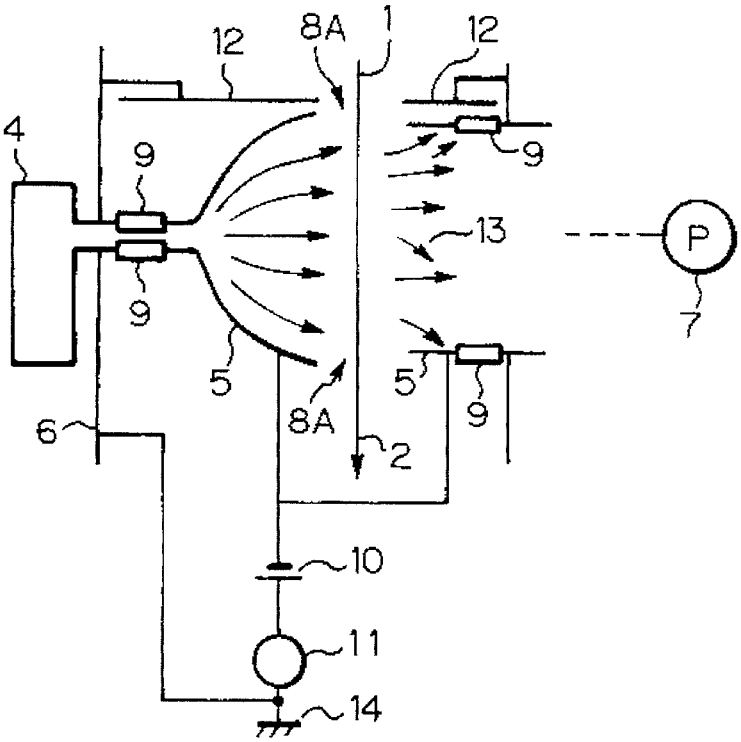
FIG. 4 is a diagram illustrating a fourth embodiment of a beam charge-exchanging apparatus according to the present invention, wherein holes through which beams pass are provided in the middle of a divergent nozzle and beam quantity measuring means is incorporated.
Figure 5:
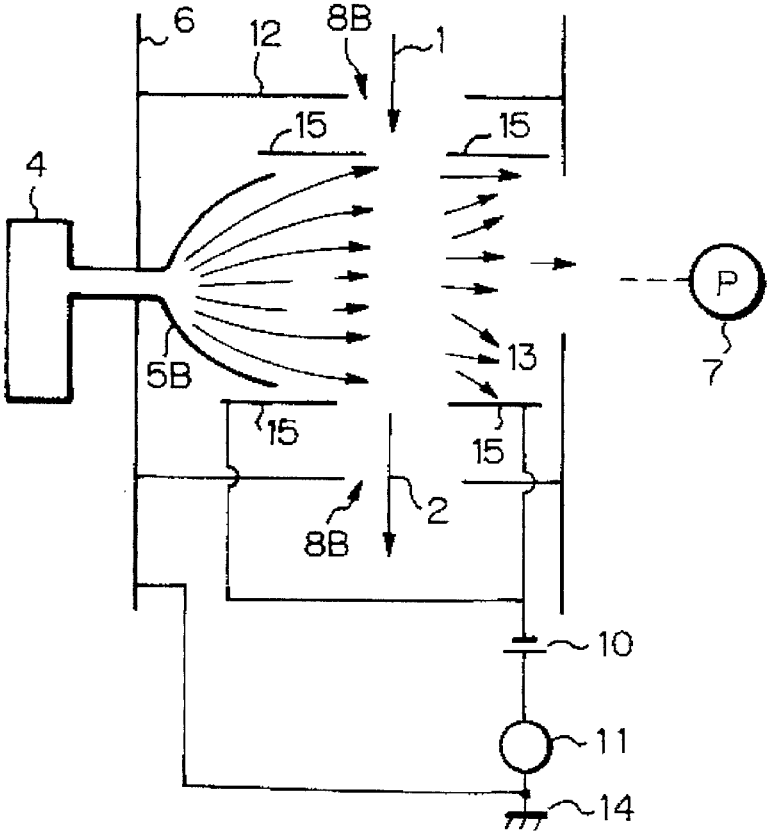
FIG. 5 is a diagram illustrating a fifth embodiment of a beam charge-exchanging apparatus according to the present invention, wherein a gas is ejected as a free jet through a nozzle of a reservoir tank, and wherein a beam quantity measuring is provided.
Figure 6:
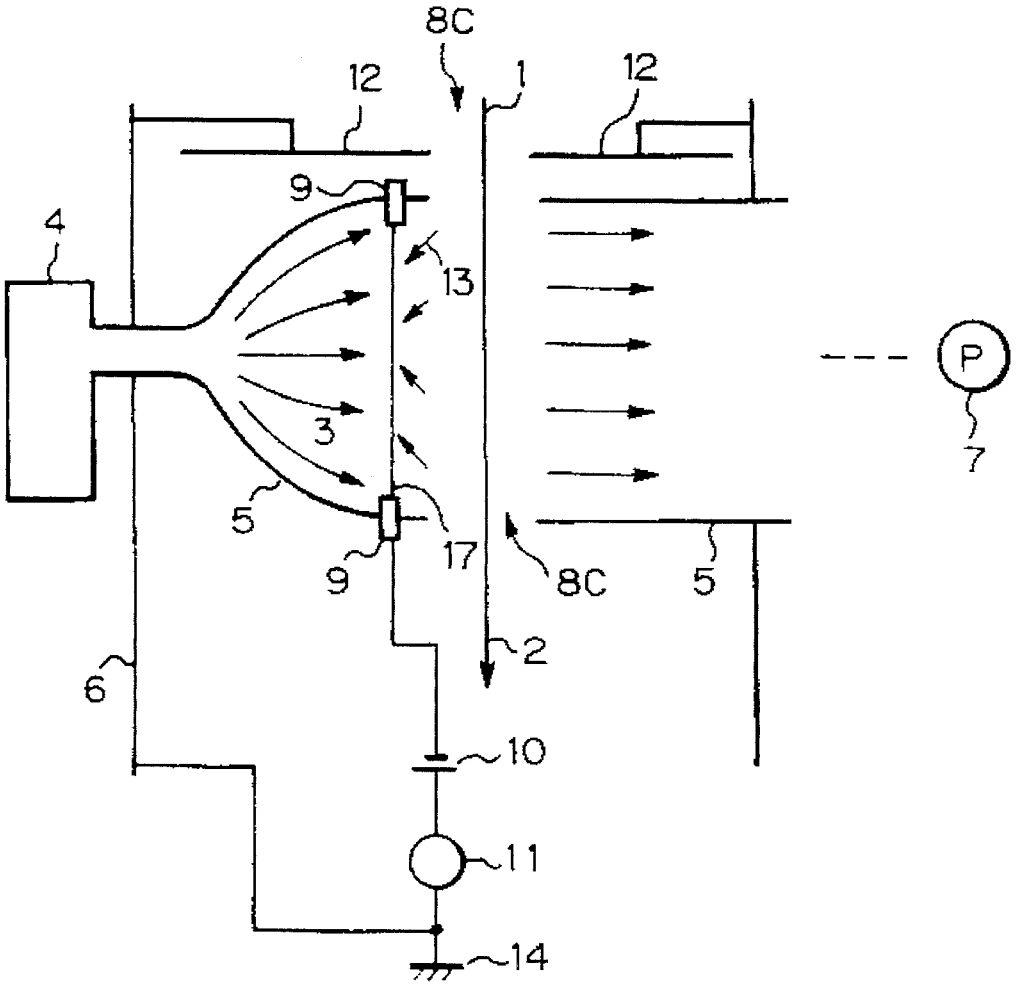
FIG. 6 is a diagram illustrating a sixth embodiment of a charge-exchanging apparatus according to the present invention, wherein a divergent nozzle is provided in the container, and a beam quantity measuring device is provided.
Figure 7:
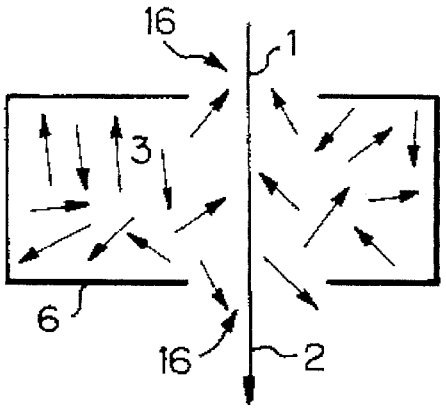
Fig. 7 PRIOR ART
FIG. 7 is a diagram illustrating a conventional beam charge exchanging apparatus.

FIGS. 4 through 6 show fourth through sixth embodiments of a beam charge exchanging apparatus of the present invention. In the figures, the same reference numerals used in FIGS. 1 to 3 denote the same or corresponding components. In the drawings, reference numeral 9 denotes an insulator composed of ceramic or the like to electrically isolate the potential of the nozzle 5 from the gas container 6; reference numeral 10 denotes a bias power supply which provides potential to an ion capturing electrode such as a divergent nozzle 5 or the like to electrostatically attract an ionized gas 13 thereto; reference numeral 11 denotes an ammeter for measuring ion current flowing into the divergent nozzle 5; and reference numeral 12 denotes a shielding plate for preventing the measurement of false current caused by the charged particle beam 1 before undergoing the charge exchange when it is irradiated to the nozzle 5. Reference numeral 14 denotes an ordinary ground which is connected to the gas container 6.

FIG. 4 shows the gas divergent nozzle 5 which has, at the middle thereof, holes 8A through which the beams 1 and 2 pass. This structure allows the charged particle (ion) beam 1 to pass through a gas 3 issuing from the gas reservoir tank 4 and which gas has been expanded and accelerated by the gas nozzle 5 so as to convert the charged particle beam 1 into the neutral particle beam 2.

FIG. 5 shows the fluid formed as a free jet in the container 6 by a nozzle 5B of the gas reservoir tank 4. Reference numeral 15 denotes an electrode for capturing the gas which has ionized at a location other than the nozzle 5. Holes 8B through which the beams 1 and 2 pass are provided in the top and bottom surfaces of the container 6 and the electrode 15. This structure allows the charged particle (ion) beam 1 to pass through the holes 8B of the container 6 and through the high speed fluid, which flows as a free jet from the nozzle 5B of the gas reservoir tank 4 so as to convert the charged particle beam 1 into the neutral particle beam 2.

The apparatus shown in FIG. 6 has the gas divergent nozzle 5 provided in the container 6; charges are exchanged between the fluid, which has been expanded and accelerated, and the charged particle beam 1, which enters through the hole 8C of the container 6 and produces the neutral particle beam 2 which exits through another hole 8C. Reference numeral 17 denotes an electrode which is electrically insulated from the gas nozzle 5 and which, when unpressed with a voltage from the power supply 10, captures the ionized gas 13. The ion capturing electrode 17 may be shaped like a bar(s).

The ion capturing electrode 17 positioned in the high speed fluid 3 creates vortices in the fluid flowing behind the bar or bars constituting the electrode and the vortices interact thereby creating a density gradient in the high speed fluid 3. Thus, a high density portion of the fluid may be created in the area where the charged particle beam 1 passes but which still enables effective charge exchange to be performed.

The embodiments shown in FIGS. 4 to 6 are similar to those of the embodiments shown in FIGS. 1 to 3 in that the charges are effectively exchanged between the ion beam or charged particle beam i and high speed fluid 3 within the gas container 6 or the nozzle 5 by passing the charged particle beam 1 through the high speed fluid 3. However, the former are different from the latter in that, in the former, the ionized gas generated by the charge exchange process is captured on the electrode or the nozzle and the quantity of the captured ionized gas is measured as an electric current to determine the quantity of the neutral particles generated by the charge exchange. This will be explained in more detail.

For instance, by passing the ion beam 1 through the high speed fluid 3 constituted by Ar gas, the high speed gas removes the charge from the ion beam (charged particle) 1 to convert it into the neutral particle beam 2. At this time, some Ar particles in the high speed gas fluid 3 are charged (ionized) to provide the $Ar^+$ gas 13. In the embodiments shown in FIGS. 4 through 6, the ionized $Ar^+$ gas 13 for example has an electron energy (eV) of about 0.06 eV; therefore, a bias voltage of approximately −1 V which is applied to the nozzle 5 or the ion capturing electrodes 15 and 17 is so high as to attract the ionized gas 13.

The voltage applied to the nozzle 5 or the ion capturing electrodes 15 and 17, however, may be 50 V or more, considering that the energy generated when the ionized gas is separated is about a few eV and the electron energy generated when the gas collides with ions ranges from about 5 to 30 eV.

The gas 13 which has ionized in the high speed gas fluid 3 is captured by the divergent nozzle electrode 5 in the embodiment shown in FIG. 4 or by the capturing electrode 15 in the embodiment shown in FIG. 5 or by the capturing electrode 17 in the embodiment shown in FIG. 6 by the bias voltage applied to the electrodes from the power supply 10. When the ionized gas 13 is captured by the electrode 5, 15, or 17, current flows through the ground 14 and the current is measured by the ammeter 11, whereby the quantity of the charge of the ionized gas 13 can be determined. The quantity of the charge of the ionized gas 13 is equal to the quantity of the charge of the beam of the neutral particle beam 2 produced from the charged particle beam 1 by the high speed fluid 3, therefore, the current measured by the ammeter 11 is proportional to the quantity of the neutral articles obtained by the charge exchange process.

Hence the neutral particle beam is electrically neutral, it was impossible to electrically measure the quantity of neutral particles in the past. According to the apparatuses of the invention, however, an efficient charge exchange and the measurement of the quantity of neutral particles become possible.

According to the present invention, a smaller apparatus than that employed in the past can used to neutralize a large quantity of beams at high efficiency and nontheless maintain the vacuum outside of the charge-exchanging apparatus. The apparatus is also capable of neutralizing especially high energy charged particle (ion) beams, such as beams of about a few MeV.

In addition, according to the present invention, a comparatively small apparatus can be used to facilitate the charge-exchanging of a large quantity of beams with high efficiency while maintaining the vacuum outside the container, and to monitor the quantity of neutral particles resulting from the charge exchange.

Further, according to the charge exchanging apparatus of the present invention, a large quantity of electrically neutral particle beams can be obtained and the quantity of neutral particles can be measured. Hence, a predetermined quantity of neutral particles can be implanted, for example, instead of ions into a semiconductor using techniques known in the ion implantation art. The use of neutral particles solves the problem of charging-up which takes place when implanting an impurity into, for example, an insulation film. In addition, since precise irradiation control, which is an advantage of the ion implanting art, can be accomplished by monitoring the quantity of neutral particles produced by the charge exchange, a significant industrial advantage is expected.

What is claimed is:

1. A beam charge exchanging apparatus comprising:

a container disposed in a vacuum, said container having an entrance hole through which a particle beam is to be introduced, and an exit hole from which a beam leaves the container; and fluid introduction means for introducing fluid into said container as a flow having a molecular velocity M of greater than 1.2, wherein M is Mach value, and in a direction the velocity vector of which is not directed toward the entrance and exit holes of the container but which will intersect a particle beam introduced into the container through said entrance hole, whereby the fluid will collide with the particle beam to exchange charges therewith, said fluid introduction means comprising a pressurized fluid reservoir, and a divergent nozzle which is connected to and diverges in a direction away from said reservoir.

2. A beam charge exchanging apparatus as claimed in claim 1, wherein said fluid introduction means introduces the fluid into said container as a flow having a molecular velocity M of greater than 1.2 and less than 5, such that the molecular velocity of the stream is supersonic.

3. A beam charge exchanging apparatus as claimed in claim 1, wherein said fluid introduction means introduces the fluid into said container as a flow having a molecular velocity M of greater than 5, such that the molecular velocity of the stream is hypersonic.

4. A beam charge exchanging apparatus as claimed in claim 1, wherein said fluid introduction means introduces the fluid into said container as a stream having a free molecular flow.

5. A beam charge exchanging apparatus as claimed in claim 2, wherein said fluid introduction means introduces the fluid into said container as a stream having a free molecular flow.

6. A beam charge exchanging apparatus as claimed in claim 3, wherein said fluid introduction means introduces the fluid into said container as a stream having a free molecular flow.

7. A beam charge exchanging apparatus as claimed in claim 1, wherein said fluid introduction means introduces a liquid into said container.

8. A beam charge exchanging apparatus as claimed in claim 1, wherein said fluid introduction means introduces a metallic vapor into said container.

9. A beam charge exchanging apparatus as claimed in claim 1, and further comprising a pump for discharging the fluid from said container after the fluid has collided with and exchanged charges with the particle beam.

10. A beam charge exchanging apparatus comprising:

a container disposed in a vacuum, said container having an entrance hole through which a particle beam is to be introduced, and an exit hole from which a beam leaves the container;

fluid introduction means for introducing fluid into said container as a flow having a molecular velocity M of greater than 1.2, wherein M is Mach value, and in a direction the velocity vector of which is not directed toward the entrance and exit holes of the container but which will intersect a particle beam introduced into the container through said entrance hole, whereby the fluid will collide with the particle beam to exchange charges therewith, said fluid introduction means comprising a pressurized fluid reservoir, and a divergent nozzle which is connected to and diverges in a direction away from said reservoir; and detecting means for detecting a quantity of neutral particles resulting from the exchange of charges by measuring the quantity of ionized fluid generated by said exchange as an electric current.

11. A beam charge exchanging apparatus as claimed in claim 10, wherein said fluid introduction means introduces the fluid into said container as a flow having a molecular velocity M of greater than 1.2 and less than 5, such that the molecular velocity of the stream is supersonic.

12. A beam charge exchanging apparatus as claimed in claim 10, wherein said fluid introduction means introduces the fluid into said container as a flow having a molecular velocity M of greater than 5, such that the molecular velocity of the stream is hypersonic.

13. A beam charge exchanging apparatus as claimed in claim 10, wherein said fluid introduction means introduces the fluid into said container as a stream having a free molecular flow.

14. A beam charge exchanging apparatus as claimed in claim 11, wherein said fluid introduction means introduces the fluid into said container as a stream having a free molecular flow.

15. A beam charge exchanging apparatus as claimed in claim 12, wherein said fluid introduction means introduces the fluid into said container as a stream having a free molecular flow.

16. A beam charge exchanging apparatus as claimed in claim 10, wherein said fluid introduction means introduces a liquid into said container.

17. A beam charge exchanging apparatus as claimed in claim 10, wherein said fluid introduction means introduces a metallic vapor into said container.

18. A beam charge exchanging apparatus as claimed in claim 10, and further comprising a pump for discharging the fluid from said container after the fluid has collided with and exchanged charges with the particle beam.

19. A beam charge exchanging apparatus as claimed in claim 10, wherein said divergent nozzle has openings therethrough located within said container, and said detecting means comprises a bias power supply connected to said nozzle so as to provide a potential thereto, whereby the nozzle becomes an electrode that will attract ionized fluid, and an ammeter connected to said nozzle.

20. A beam charge exchanging apparatus as claimed in claim 10, wherein said nozzle has an end open within said container, and said detecting means comprises an electrode disposed within said end of said nozzle, a bias power supply connected to said electrode so as to provide a potential thereto, whereby the electrode will attract ionized fluid, and an ammeter connected to said electrode.

21. A beam charge exchanging apparatus as claimed in claim 19, and further comprising a shield disposed between the entrance hole of said container and the electrode so as to shield the electrode from the particle beam and thereby prevent a false measurement by said detection means.

22. A beam charge exchanging apparatus as claimed in claim 20, and further comprising a shield disposed between the entrance hole of said container and the electrode so as to shield the electrode from the particle beam and thereby prevent a false measurement by said detection means.

* * * * *